US008170430B2

(12) United States Patent
Nagatsuka

(10) Patent No.: US 8,170,430 B2
(45) Date of Patent: May 1, 2012

(54) COLOR IMAGE FORMING APPARATUS, COLOR IMAGE FORMING METHOD, COMPUTER PROGRAM PRODUCT

(75) Inventor: Shingo Nagatsuka, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 860 days.

(21) Appl. No.: 12/106,661

(22) Filed: Apr. 21, 2008

(65) Prior Publication Data

US 2008/0279599 A1 Nov. 13, 2008

(30) Foreign Application Priority Data

May 10, 2007 (JP) ..... 2007-125716

(51) Int. Cl.
*G03G 15/00* (2006.01)
*G03G 15/01* (2006.01)

(52) U.S. Cl. ..... 399/44; 399/301

(58) Field of Classification Search ..... 399/44, 399/301; 347/116
See application file for complete search history.

(56) References Cited

U.S. PATENT DOCUMENTS

2005/0281575 A1* 12/2005 Yoshizuka et al. ..... 399/55
2006/0029407 A1* 2/2006 Sakamoto ..... 399/44
2007/0053710 A1* 3/2007 Shibaki et al. ..... 399/81

FOREIGN PATENT DOCUMENTS

| | | | |
|---|---|---|---|
| JP | 10-213943 | | 8/1998 |
| JP | 2003-207976 | | 7/2003 |
| JP | 2005189356 | A * | 7/2005 |
| JP | 2006-47547 | | 2/2006 |
| JP | 2006-119367 | | 5/2006 |
| JP | 2006-192798 | | 7/2006 |
| JP | 2006-284773 | | 10/2006 |

OTHER PUBLICATIONS

Office Action mailed Dec. 13, 2011, in Japanese Patent Application No. 2007-125716, filed May 10, 2007.

Office Action mailed Feb. 28, 2012, in Japanese Patent Application No. 2007-125716 filed May 10, 2007.

* cited by examiner

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

An out-of-color registration table containing a correspondence of amounts of out-of-color registration detected by an out-of-color-registration amount detector and machine states detected by a machine state detector is prepared. The out-of-color registration table is updated when there is a change in the current machine state.

12 Claims, 10 Drawing Sheets

COLOR IMAGE FORMING APPARATUS, COLOR IMAGE FORMING METHOD, COMPUTER PROGRAM PRODUCT

CROSS-REFERENCE TO RELATED APPLICATIONS

The present application claims priority to and incorporates by reference the entire contents of Japanese priority document 2007-125716 filed in Japan on May 10, 2007.

BACKGROUND OF THE INVENTION

1. Field of the Invention

The present invention relates to a color image forming apparatus, a color image forming method, a color image forming program, and a recording medium.

2. Description of the Related Art

In an electrophotographic printer, out-of-color registration occurs if there is distortion of a lens or a mirror due variations in the internal temperature or deterioration with age. Therefore, there has been a method for forming an out-of-color registration detection pattern on a transfer belt at a predetermined timing, and reading the pattern by a sensor, thereby correcting out-of-color registration.

However, if an out-of-color registration correction operation is performed each time the change in the internal temperature is above a threshold, pattern formation or a detection operation must be executed each time the out-of-color registration correction operation is performed. This causes problems that a user cannot perform printing while the out-of-color registration correction operation is being performed, toner consumption increases in order to perform pattern formation, a load on a cleaning member that collects the toner used for forming the pattern increases, and waste toner collection capacity will have to be increased.

Japanese Patent Application Laid-open No. 2003-207976 discloses a technique in which a correspondence table of amounts of out-of-color registration with respect to temperatures is prepared in advance and an amount of out-of-color registration for the current internal temperature of a machine is determined from this correspondence table. In this technique, thus, it is possible to perform out-of-color registration without forming the out-of-color registration detection pattern.

However, in the above technique, because always the same amount of out-of-color registration is used, variations in the amount of out-of-color registration due to aging or machine-specific factors cannot be taken into account. As a result, the detection accuracy of out-of-color registration is not satisfactory.

SUMMARY OF THE INVENTION

It is an object of the present invention to at least partially solve the problems in the conventional technology.

According to an aspect of the present invention, there is provided a color image forming apparatus including a color image forming unit that forms a toner image of a corresponding one of a plurality of colors on a corresponding one of a plurality of photoconductors and sequentially transfers the toner images from the photoconductors onto a transfer medium; an out-of-color-registration amount detector that detects an amount of out-of-color registration for each color by measuring an out-of-color registration detection pattern formed on the transfer medium; a write-position correction-amount setting unit that sets a write-position correction amount with respect to one or more of the photoconductors based on the amount of out-of-color registration detected by the out-of-color-registration amount detector; a machine state detector that detects a machine state indicative of a state of a body of the color image forming apparatus at a time point when the out-of-color-registration amount detector detects an amount of out-of-color registration; and an out-of-color-registration table constructing unit that constructs an out-of-color registration table containing a correspondence of the amount of out-of-color registration detected by the out-of-color-registration amount detector and the machine state detected by the machine state detector.

According to another aspect of the present invention, there is provided a color image forming method including forming forms a toner image of a corresponding one of a plurality of colors on a corresponding one of a plurality of photoconductors and sequentially transfers the toner images from the photoconductors onto a transfer medium; first detecting including detecting an amount of out-of-color registration for each color by measuring an out-of-color registration detection pattern formed on the transfer medium; setting a write-position correction amount with respect to one or more of the photoconductors based on the amount of out-of-color registration detected at the first detecting; second detecting including detecting a machine state indicative of a state of a body of the color image forming apparatus at a time point when an amount of out-of-color registration is detected at the first detecting; and constructing an out-of-color registration table containing a correspondence of the amount of out-of-color registration detected by the out-of-color-registration amount detector and the machine state detected by the machine state detector.

According to still another aspect of the present invention, there is provided a computer program product comprising a computer usable medium having computer readable program codes embodied in the medium that, when executed, causes a computer to execute the above method.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings.

A basic configuration of a color image forming apparatus as one embodiment of the present invention is explained first.

Figure 1:
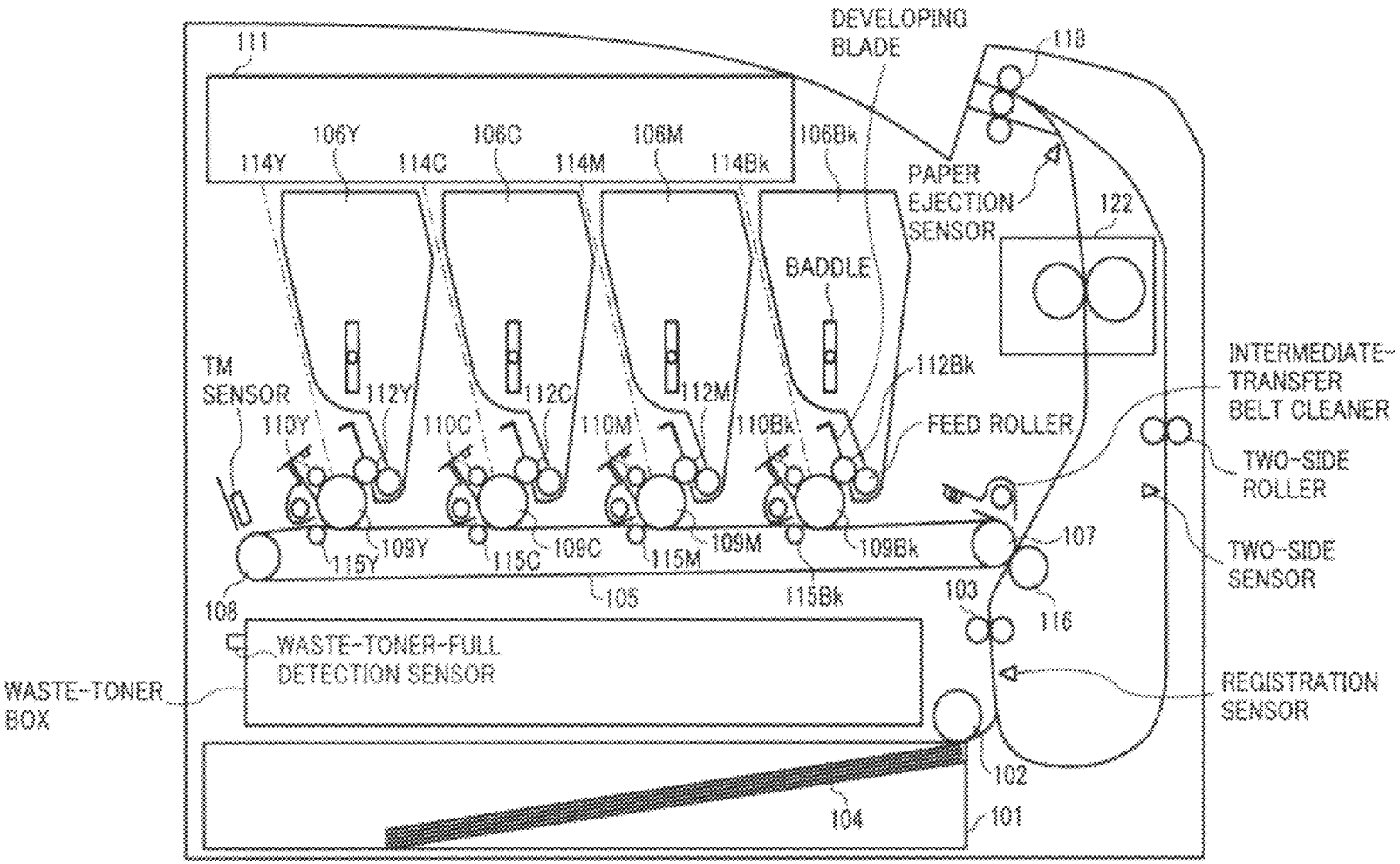
FIG. 1 depicts a schematic configuration of an image forming apparatus according to an embodiment of the present invention.

FIG. 1 depicts a schematic configuration of the image forming apparatus according to the embodiment.

The image forming apparatus has a configuration such that AIO cartridges of each color (106Bk, 106M, 106C, and 106Y) are arranged along a transfer belt 105, which is a so-called tandem type. The transfer belt 105 rotates counter-clockwise in FIG. 1, and these AIO cartridges (electrophotographic process units) 106Bk, 106M, 106C, and 106Y are arranged in order from an upstream side of a rotation direction thereof. These AIO cartridges 106Bk, 106M, 106C, and 106Y have a common internal configuration, with only the color of a toner image to be formed being different. The AIO cartridge 106Bk forms a black image, the AIO cartridge 106M forms a magenta image, the AIO cartridge 106C forms a cyan image, and the AIO cartridge 106Y forms a yellow image.

In the explanations below, the AIO cartridge 106Bk is specifically explained; however, other AIO cartridges 106M, 106C, and 106Y have the same configuration as that of the AIO cartridge 106Bk. Therefore, respective components in the image forming units 106M, 106C, and 106Y are denoted by M, C, and Y, instead of Bk added to the respective components in the image forming unit 106Bk and shown in the drawings, and explanations thereof will be omitted.

The transfer belt 105 is an endless belt entrained around a rotated secondary-transfer drive roller 107 and a transfer-belt tension roller 108. The secondary-transfer drive roller 107 is rotated by a drive motor (not shown), and the drive motor, the secondary-transfer drive roller 107, and the transfer-belt tension roller 108 function as drive means that move the transfer belt 105.

The image forming unit 106Bk includes a photoconductor 109Bk as a photoconductor, and a charger 110Bk, an exposure unit 111, a developing unit 112Bk, and a cleaner blade 113Bk arranged around the photoconductor 109Bk.

The exposure unit 111 is configured to irradiate laser beams 114Bk, 114M, 114C, and 114Y, which are exposure beams corresponding to a color of an image to be formed by the respective AIO cartridges 106Bk, 106M, 106C, and 106Y.

At the time of image formation, an outer circumference of the photoconductor 109Bk is uniformly charged by the charger 110Bk in the dark, and then exposed by the laser beams 114Bk corresponding to the black image from the exposure unit 111, to form an electrostatic latent image. The developing unit 112Bk visualizes the electrostatic latent image by black toner, thereby forming a black toner image on the photoconductor 109Bk.

The toner image is transferred onto the transfer belt 105 by an action of a primary transfer roller 115Bk at a position where the photoconductor 109Bk and the transfer belt 105 come in contact with each other (primary transfer position). Due to the transfer, an image by the black toner is formed on the transfer belt 105.

The photoconductor 109Bk having finished the transfer of the toner image stands by for the next image formation, with the unnecessary toner remaining on the outer circumference thereof being wiped out by the cleaner blade 113Bk.

The transfer belt 105, onto which the black toner image has been transferred by the AIO cartridge 106Bk, moves to the next AIO cartridge 106M. By the AIO cartridge 106M, a magenta toner image is formed on the photoconductor 109M according to the same process as the image forming process by the AIO cartridge 106Bk, and the magenta toner image is superposed on the black image formed on the transfer belt 105 and transferred thereto.

The transfer belt 105 further moves to the next AIO cartridges 106C and 106Y, and a cyan toner image formed on the photoconductor 109C and a yellow toner image formed on the photoconductor 109Y are superposed on and transferred to the transfer belt. Thus, a full color toner image is formed on the transfer belt 105.

At the time of forming the image, in the case of monochrome printing, the primary transfer rollers 115M, 115C, and 115Y are retreated to positions apart from the photoconductors 109M, 109C, and 109Y, respectively, and the above image forming process is performed only for the black.

A paper feeder having a paper feed tray 101, a paper feed roller 102, and a registration roller 103 is provided below the transfer belt 105. A secondary transfer roller 116 is also provided to face the secondary-transfer drive roller 107.

The secondary-transfer drive roller 107 forms a secondary transfer nip by putting the transfer belt 105 between the secondary transfer roller 116 and itself. A fuser 122 and a paper ejection roller 118 are provided above the secondary transfer nip.

The paper feed tray 101 stores sheets 104 accumulated therein as a recording medium, and the paper feed roller 102 abuts against the uppermost sheet 104. The paper feed roller 102 is rotated by a drive unit (not shown), and the rotation thereof is temporarily suspended in a state with the edge of the uppermost sheet 104 abutting against the registration roller 103. The sheet 104 is then fed toward the secondary transfer nip, to which a transfer bias is applied at an appropriate timing. The toner image formed on the transfer belt 105 is transferred onto the sheet 104 at the secondary transfer nip.

Transfer residual toner, which has not been transferred onto the sheet 104, adheres on the transfer belt 105 after having passed the secondary transfer nip. The transfer residual toner is cleaned by an intermediate-transfer belt cleaner.

The toner image transferred onto the surface of the sheet 104 having passed the secondary transfer nip is fixed by heat and pressure at the time of passing through between rollers of the fuser 122. Thereafter, the sheet 104 is ejected to the outside of the machine by the paper ejection roller 118.

A basic electric configuration of the image forming apparatus according to the embodiment is explained next with reference to FIG. 2.

Figure 2:
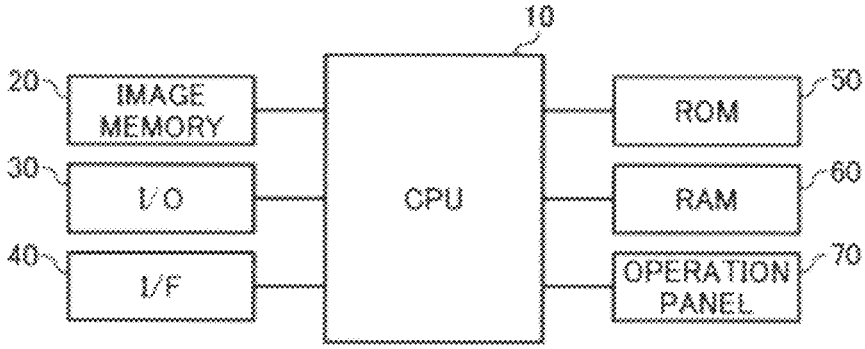
FIG. 2 is one example of a hardware configuration of the image forming apparatus shown in FIG. 1.

FIG. 2 is one example of the electric configuration of the image forming apparatus shown in FIG. 1.

The image forming apparatus includes a central processing unit (CPU) 10, an image memory 20, an input/output unit (I/O unit) 30, an interface (I/F) 40, a read only memory (ROM) 50, a random access memory (RAM) 60, and an operation panel 70.

The CPU 10 controls respective units constituting the image forming apparatus according to a program stored in the ROM 50. The image memory 20 temporarily stores image data included in print data.

The I/O 30 controls input and output of electrical equipment such as the image forming unit and the sensor.

The I/F 40 receives print data and enquiry and response from/to the user from a personal computer or a server connected thereto via a cable or the like.

The ROM 50 stores a program for controlling the entire apparatus.

The RAM 60 temporarily stores various pieces of information of the apparatus. The operation panel 70 is for the user to ascertain the state of the apparatus and set an operation change of the apparatus.

An out-of-color registration correction process according to the embodiment is explained next.

Generally, the out-of-color registration correction process is for detecting the out-of-color registration detection pattern including four-color strip-shaped toner patterns, whose color formed on the transfer belt is different from each other, by a TM sensor, and detecting an amount of out-of-color registration between the respective color patterns, to correct a write timing or the like so that the amount of out-of-color registration becomes equal to or less than a predetermined value. One example of the out-of-color registration detection pattern to be used for the out-of-color registration correction process is shown in FIG. 3.

Figure 3:
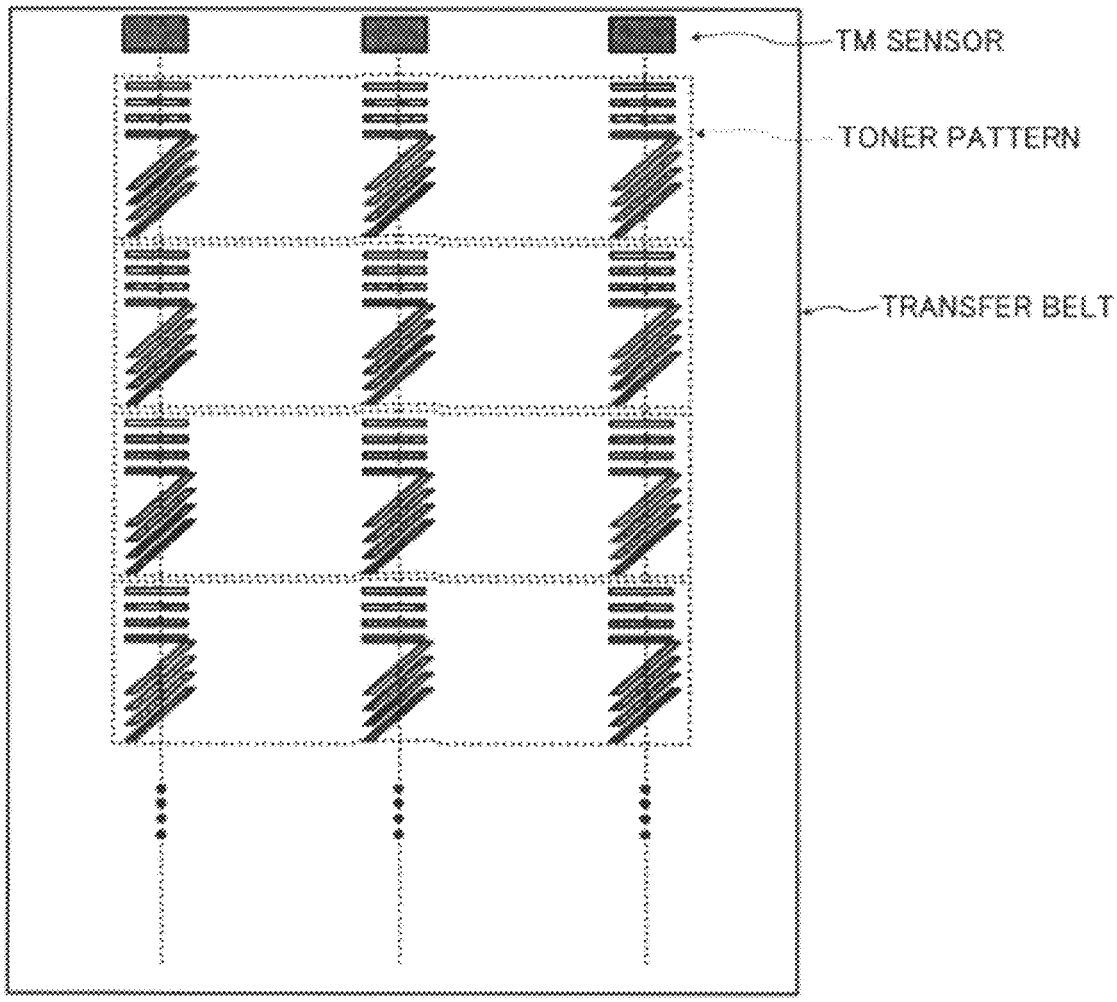
FIG. 3 is one example of an out-of-color registration detection pattern used for an out-of-color registration correction process.

The out-of-color registration detection pattern is such that, as shown in FIG. 3, a series of strip-shaped toner patterns are output to a plurality of places in a main scanning direction, matched with the arrangement of the TM sensors. A main-scanning-direction deviation amount in registration and a sub-scanning-direction deviation amount in registration are calculated based on edge information of respective toner patterns detected by the TM sensor, to set a correction amount of a write position.

The color image forming apparatus of the present invention explained above is realized by a color image forming program for causing a computer to execute a color image forming process. As the computer, for example, general-purpose computers such as a personal computer and a workstation can be used; however, the present invention is not limited thereto.

Accordingly, the color image forming apparatus of the present invention can be realized in any place, so long as there is a computer environment in which the color image forming program can be executed.

The color image forming program can be stored in a computer readable recording medium.

Types of the recording medium can be, for example, a computer readable recording medium such as a compact disc read only memory (CD-ROM), a flexible disk (FD), a CD-recordable (CD-R), or a digital versatile disk (DVD), or a semiconductor memory such as a hard disc drive (HDD), a flash memory, a RAM, a ROM, or a ferroelectric random access memory (FeRAM).

The above embodiment is merely an example of exemplary embodiments of the present invention. Therefore, the present invention is not limited thereto, and various modifications can be made without departing from the scope of the invention.

Figure 4:
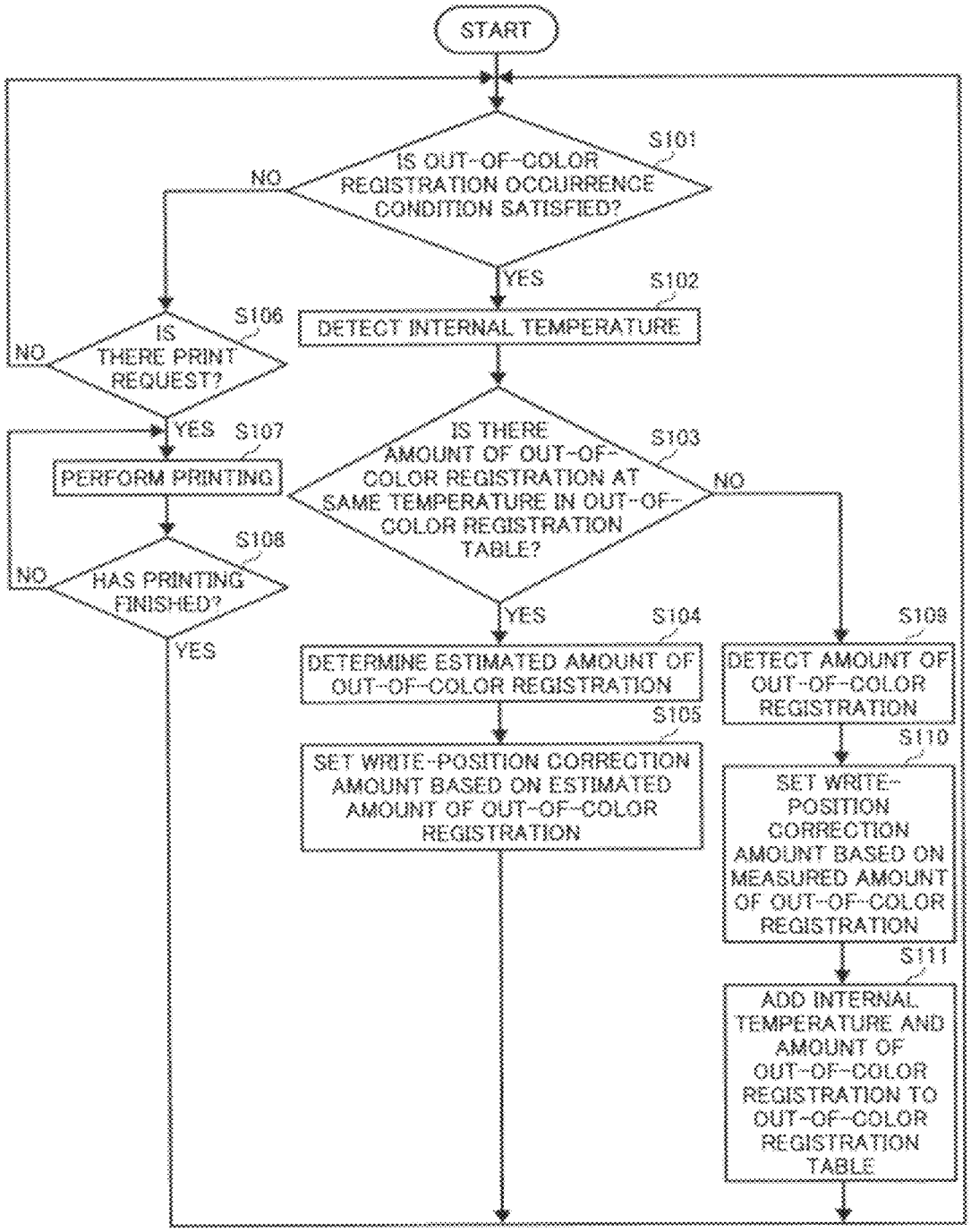
FIG. 4 is a flowchart of a color image forming method according to a first embodiment of the present invention.

A first embodiment of the present invention is explained with reference to FIG. 4. FIG. 4 is a flowchart of a color image forming method according to the first embodiment.

At first, it is determined whether an out-of-color registration occurrence condition is satisfied. As the out-of-color registration occurrence condition, there is a method of installing a temperature sensor inside the configuration (color image forming apparatus) to measure the internal temperature and making the determination based on a temperature difference between the measured temperature and the temperature when the out-of-color registration correction process was performed last time. A method of making the determination based on a continuous driving time of a polygon motor in the exposure unit, or a method of making the determination based on the number of prints printed continuously can be also used (Step S101).

When the out-of-color registration occurrence condition is not satisfied (NO at Step S101), it is determined whether there is a print request from a user (Step S106). If there is the print request, printing is performed (YES at Step S106, Step S107). It is then determined whether printing has finished (Step S108). If there is no print request, control returns to determination of out-of-color registration occurrence (NO at Step S106).

When the out-of-color registration occurrence condition is satisfied (YES at Step S101), the internal temperature is measured. The internal temperature can be measured by a method using the temperature sensor installed therein; however, a method of estimating the temperature based on a driving time of the polygon motor in the exposure unit can be used (Step S102).

It is then determined whether there is amount information of out-of-color registration with respect to the detected internal temperature in an out-of-color registration table (Step S103).

Table 1 is one example of the out-of-color registration table.

TABLE 1

| Internal temperature | Main-scanning-direction deviation amount in registration [μm] | | |
|---|---|---|---|
| [Degree] | Y | C | M |
| T1 | ΔY1 | ΔC1 | ΔM1 |
| T2 | ΔY2 | ΔC2 | ΔM2 |
| T3 | ΔY3 | ΔC3 | ΔM3 |
| T4 | ΔY4 | ΔC4 | ΔM4 |
| T5 | ΔY5 | ΔC5 | ΔM5 |
| T6 | ΔY6 | ΔC6 | ΔM6 |
| T7 | ΔY7 | ΔC7 | ΔM7 |
| T8 | ΔY8 | ΔC8 | ΔM8 |

The main-scanning-direction deviation amount in registration is used here as the amount of out-of-color registration; however, the present invention is not limited thereto, and other deviation amounts such as the sub-scanning-direction deviation amount in registration and a skew amount can be used.

When there is the amount of out-of-color registration at the same temperature as the detected internal temperature in the out-of-color registration table (YES at Step S103), the amount of out-of-color registration recorded in the out-of-color registration table is determined as an estimated amount of out-of-color registration (Step S104). A correction amount of the write position is set (Step S105), to return to the initial determination of out-of-color registration occurrence.

When there is no amount of out-of-color registration at the same temperature as the detected internal temperature in the out-of-color registration table (NO at Step S103), the out-of-color registration detection pattern is formed to detect the amount of out-of-color registration (Step S109), and the correction amount of the write position is set (Step S110).

Lastly, the amount of out-of-color registration actually measured and the detected internal temperature are added to the out-of-color registration table (Step S111), to return to the initial determination of out-of-color registration occurrence.

Figure 5:
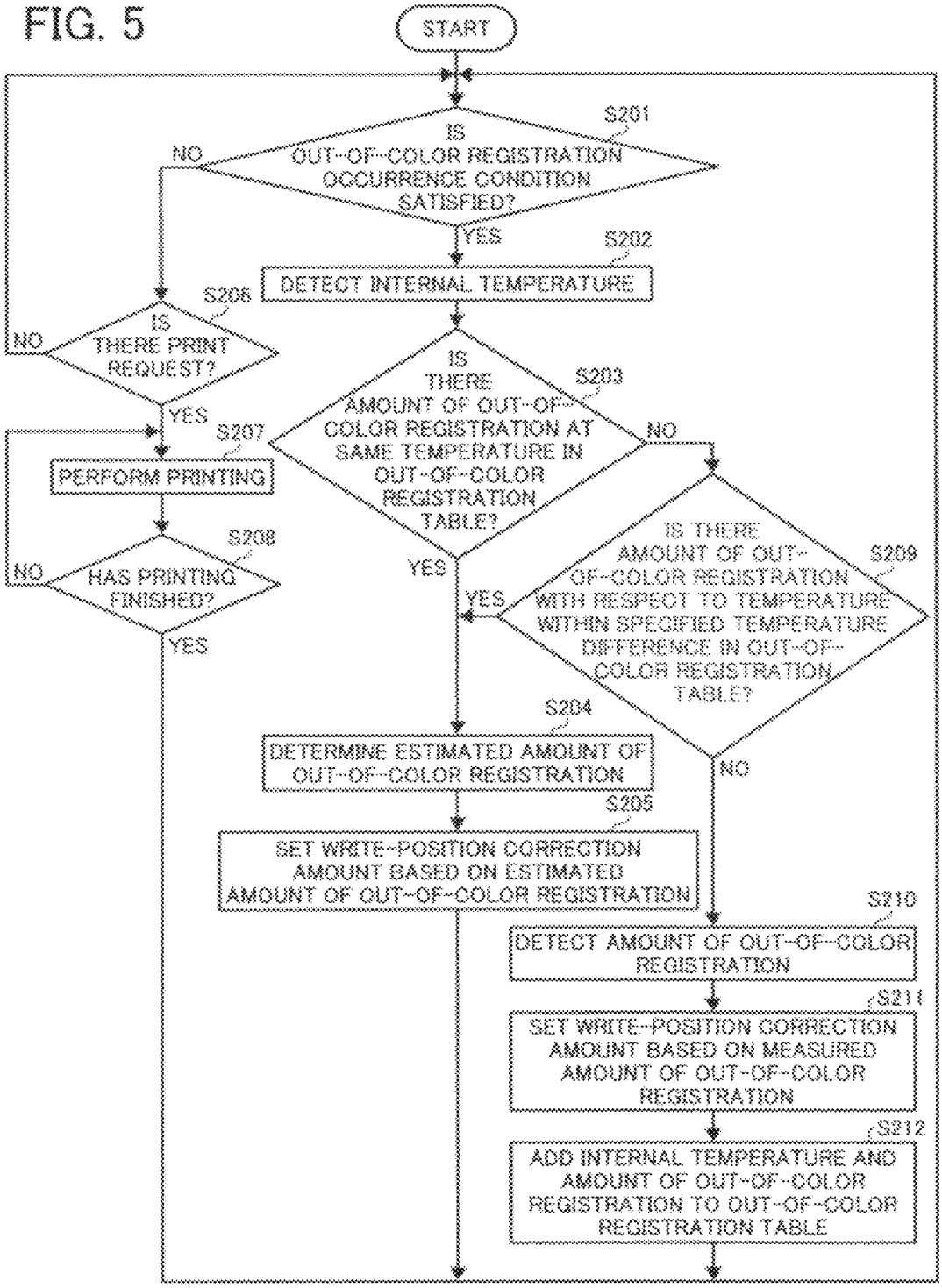
FIG. 5 is a flowchart of a color image forming method according to a second embodiment of the present invention.

A second embodiment of the present invention is explained with reference to FIG. 5. FIG. 5 is a flowchart of a color image forming method according to the second embodiment.

In the second embodiment, the process for determining the estimated amount of out-of-color registration in the configuration of the first embodiment is partially changed. The flowchart in FIG. 5 is quite similar to that in FIG. 4, and therefore explanations of the steps that are same (Step S201 is the same as Step S101, Step S202 is the same as Step S102, and Steps S206 to S208 are the same as Steps S106 to S108) will be omitted.

When there is no amount of out-of-color registration at the same temperature as the detected internal temperature in the out-of-color registration table (NO at Step S203), it is determined whether an amount of out-of-color registration with respect to a temperature within a specified temperature difference from the detected internal temperature is held in the out-of-color registration table (Step S209).

When the amount of out-of-color registration is held in the out-of-color registration table (YES at Step S209), the amount of out-of-color registration with respect to an internal temperature closest to the detected internal temperature is determined as the estimated amount of out-of-color registration (Step S204), and the correction amount of the write position is set based on the estimated amount of out-of-color registration, to return to step S201.

When the amount of out-of-color registration is not held in the out-of-color registration table (NO at Step S209), the out-of-color registration detection pattern is formed to proceed to a process for actually measuring the amount of out-of-color registration (Steps S210 to S212).

Figures 6, 6A, 6B:
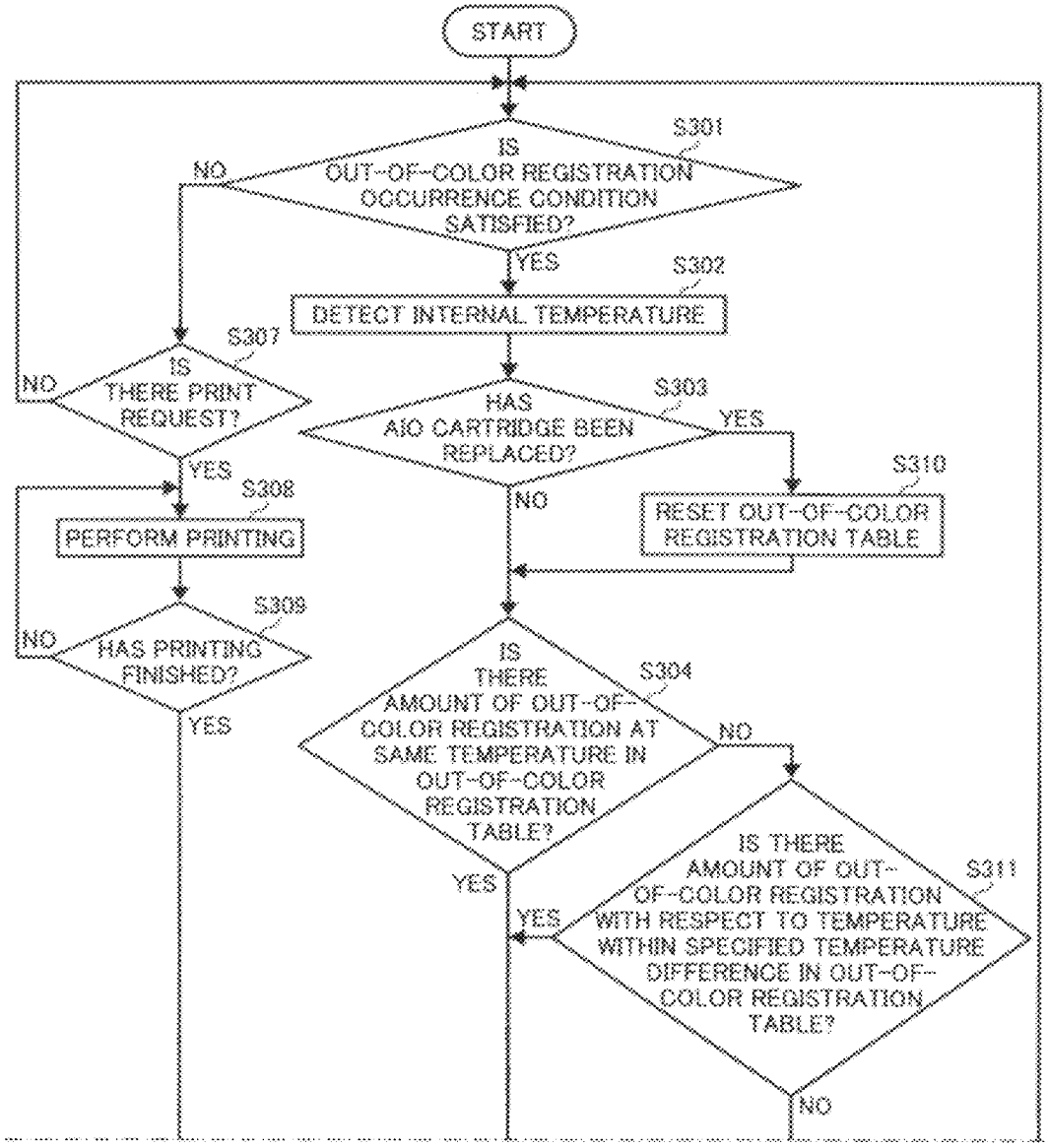
FIG. 6 is a flowchart of a color image forming method according to a third embodiment of the present invention.
Figure 6B:
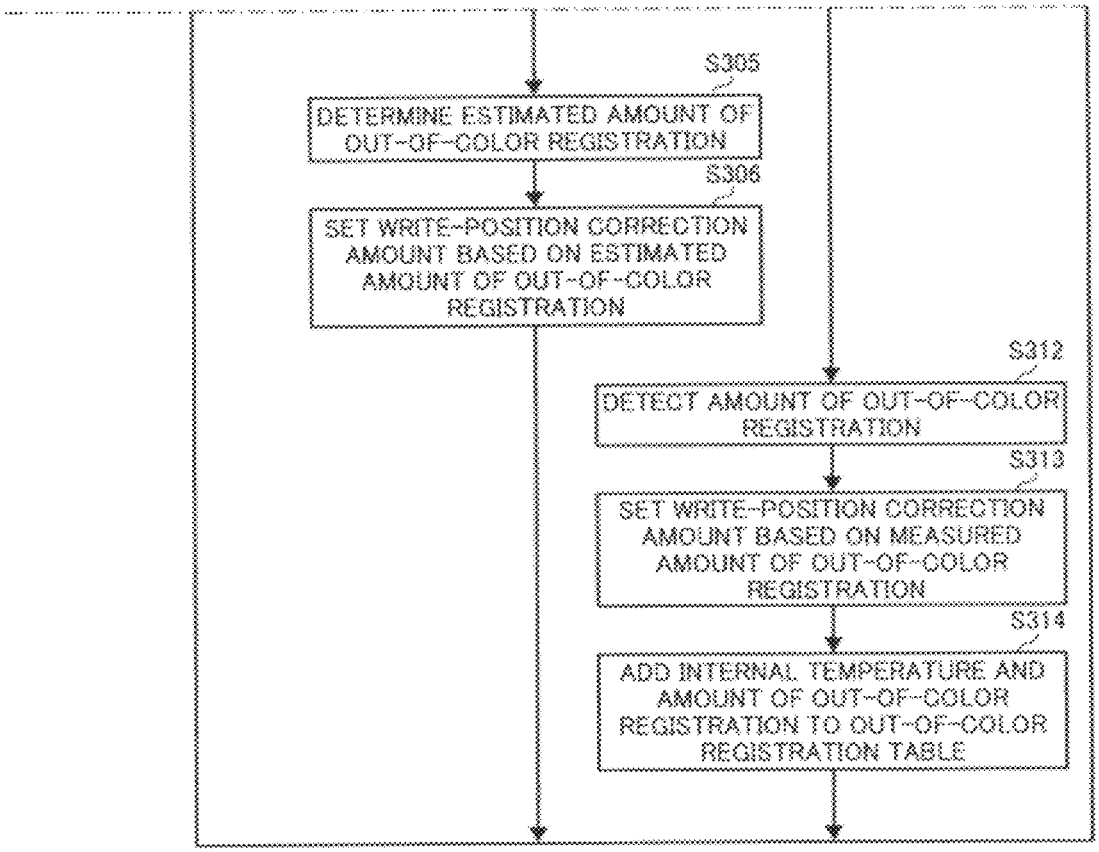

A third embodiment of the present invention is explained with reference to FIG. 6. FIG. 6 is a flowchart of a color image forming method according to the third embodiment.

In the third embodiment, a method of constructing the out-of-color registration table in the configuration of the second embodiment is partially changed. The flowchart in FIG. 6 is quite similar to that in FIG. 5, and therefore explanations of the steps that are same (Steps S307 to S309 are the same as Steps S206 to S208, and Steps S311 to S314 are the same as Steps S209 to S212) will be omitted.

When the out-of-color registration occurrence condition is satisfied (YES at Step S301), the internal temperature is detected (Step S302), to determine whether the AIO cartridge has been replaced (Step S303). The AIO cartridge is used here as the image forming unit; however, the image forming unit is not limited thereto, and replacement of the exposure unit can be detected instead thereof.

When replacement of the AIO cartridge is detected (YES at Step S303), all of the internal temperatures and the amounts of out-of-color registration held in the out-of-color registration table are deleted (reset) (Step S310). The out-of-color registration table is reconstructed by actually measuring the amount of out-of-color registration in the subsequent process (Steps S304 to S306).

Figure 7A:
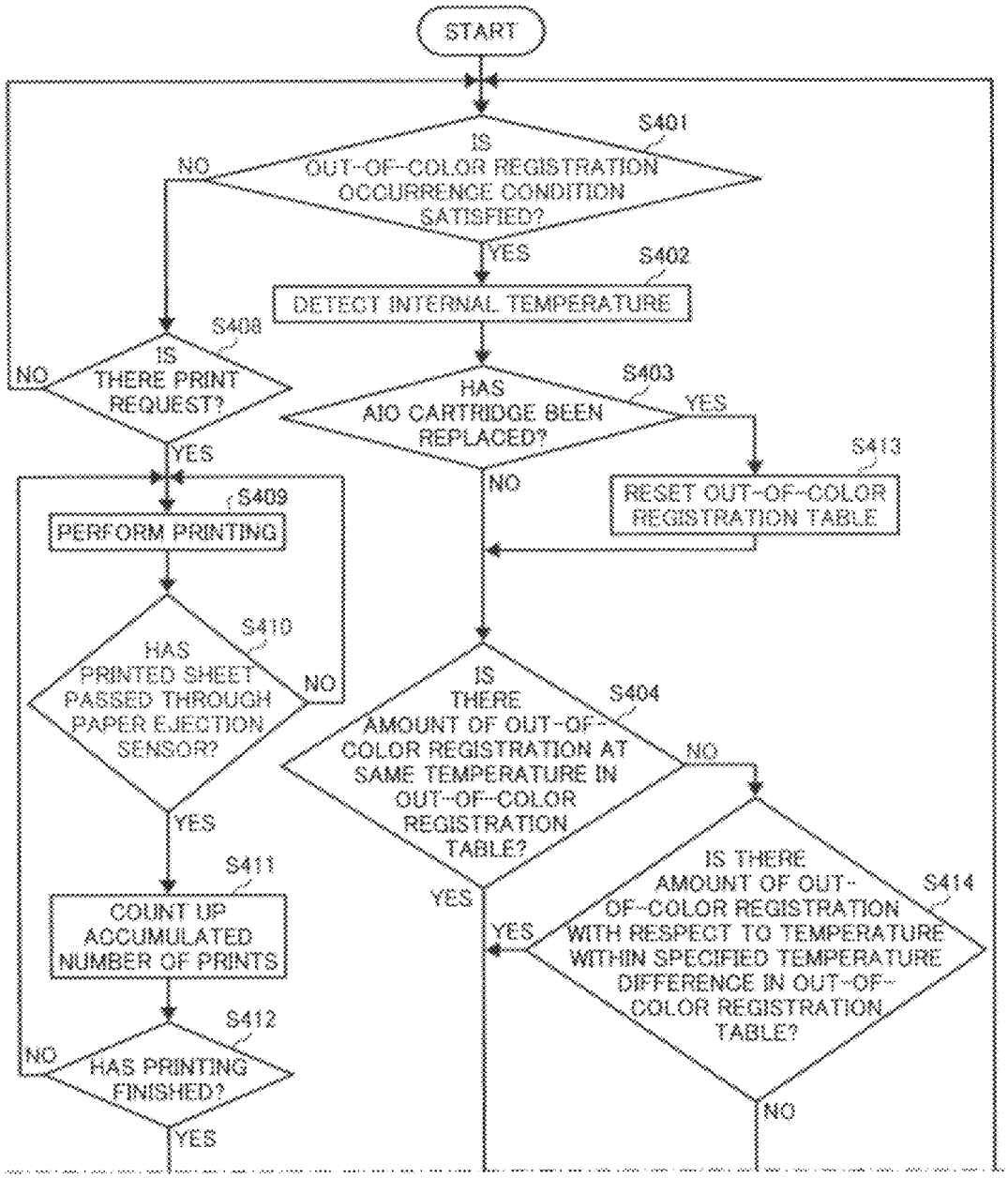
FIG. 7 is a flowchart of a color image forming method according to a fourth embodiment of the present invention.
Figure 7B:
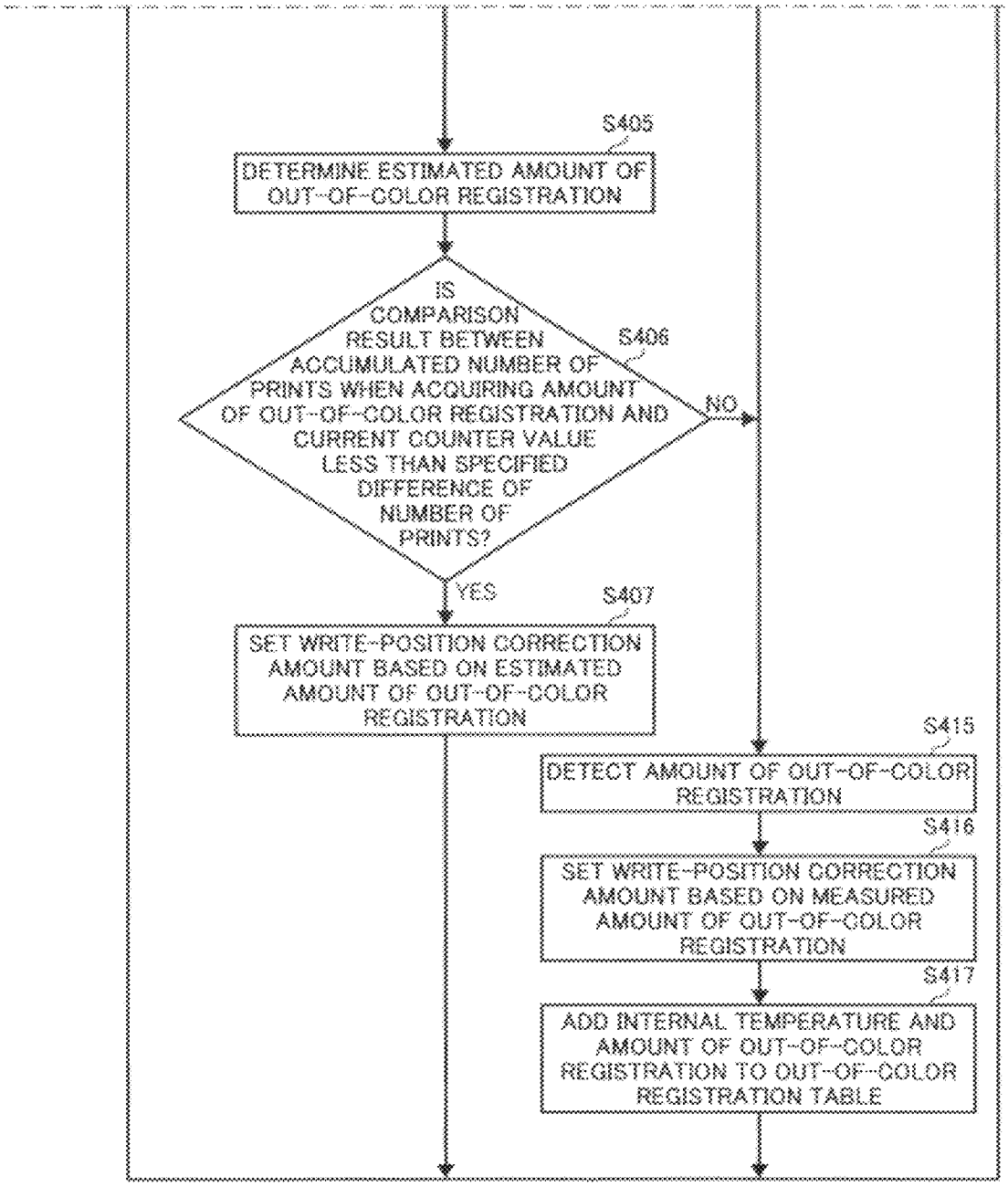

A fourth embodiment of the present invention is explained with reference to FIG. 7. FIG. 7 is a flowchart of a color image forming method according to the fourth embodiment.

In the fourth embodiment, the method of constructing the out-of-color registration table and a method of determining the estimated amount of out-of-color registration in the configuration of the third embodiment are partially changed. The flowchart in FIG. 7 is quite similar to that in FIG. 6, and therefore explanations of the steps that are same (Steps S401 to S403 are the same as Steps S301 to S303, Step S408 is the same as Step S307, Step S413 is the same as Step S310, and Step S414 is the same as Step S311) will be omitted.

In this configuration, to ascertain the total number of prints, after performing printing (Step S409), when the rear end of the printed sheet has passed through a paper ejection sensor (YES at Step S410), a counter of the accumulated number of prints is counted up (Step S411). After having finished printing (YES at Step S412), control returns to step S401.

When the out-of-color registration detection pattern is formed and the amount of out-of-color registration is actually measured (Step S415), the accumulated number of prints at the time of updating the out-of-color registration table is stored simultaneously.

Table 2 is one example of the out-of-color registration table in which the accumulated number of prints is added.

TABLE 2

| Internal temperature [Degree] | Main-scanning-direction deviation amount in registration [μm] | | | Accumulated number of prints at time of acquisition [sheets] |
|---|---|---|---|---|
| T1 | ΔY1 | ΔC1 | ΔM1 | P1 |
| T2 | ΔY2 | ΔC2 | ΔM2 | P2 |
| T3 | ΔY3 | ΔC3 | ΔM3 | P3 |
| T4 | ΔY4 | ΔC4 | ΔM4 | P4 |
| T5 | ΔY5 | ΔC5 | ΔM5 | P5 |
| T6 | ΔY6 | ΔC6 | ΔM6 | P6 |
| T7 | ΔY7 | ΔC7 | ΔM7 | P7 |
| T8 | ΔY8 | ΔC8 | ΔM8 | P8 |

After having determined the estimated amount of out-of-color registration (Step S405), the accumulated number of prints at the time of acquiring the determined estimated amount of out-of-color registration into the out-of-color registration table is compared with a counter value of the accumulated number of prints at that time (Step S406). When a comparison result is less than a specified difference of the number of prints (YES at Step S406), the correction amount of the write position is set based on the estimated amount of out-of-color registration (Step S407). When the comparison result is equal to or larger than the specified difference of the number of prints (NO at Step S406), the out-of-color registration detection pattern is formed to actually measure the amount of out-of-color registration (Step S416), and the out-of-color registration table is updated according to the detected amount of out-of-color registration (Steps S416 and S417).

Figure 8A:
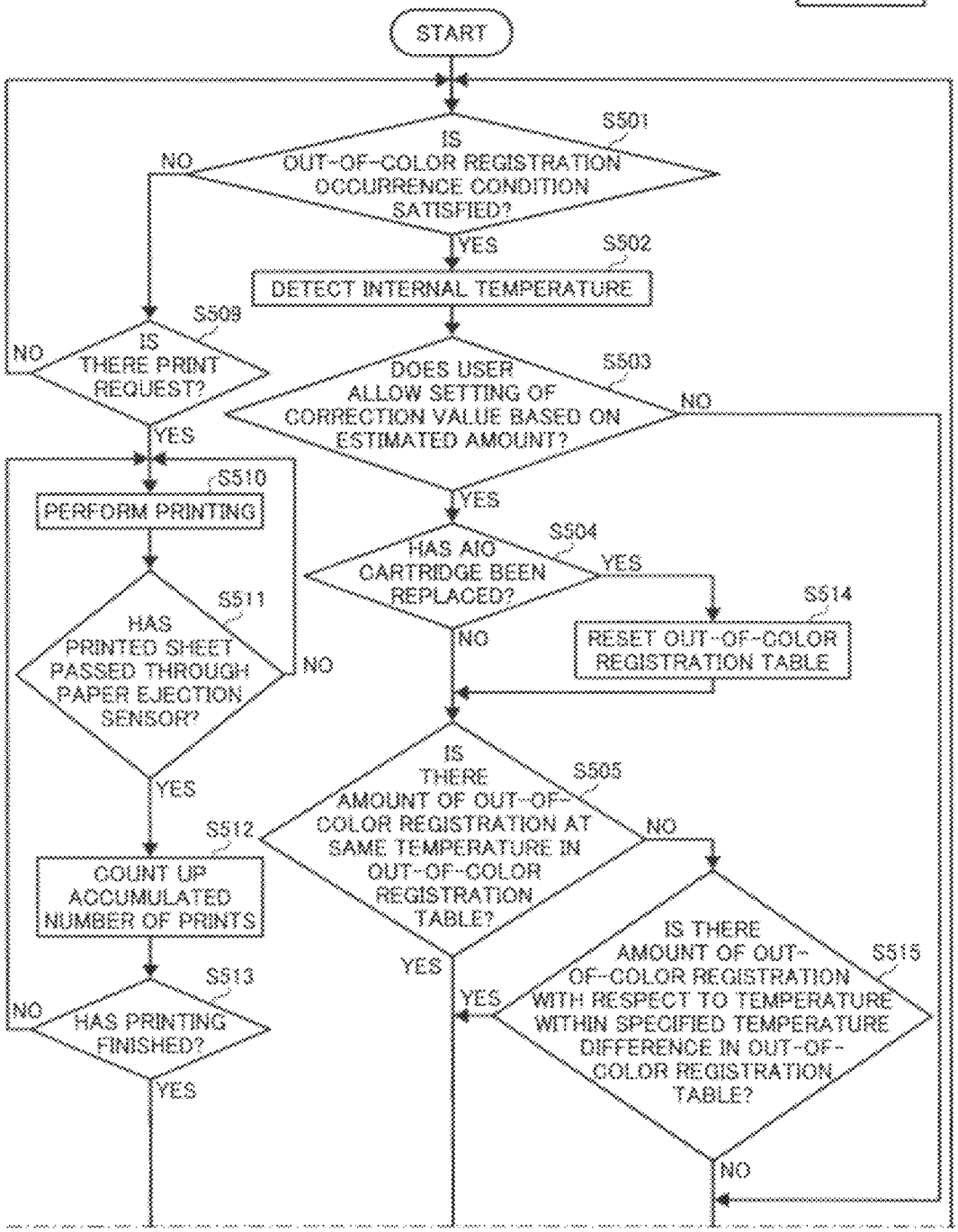
FIG. 8 is a flowchart of a color image forming method according to a fifth embodiment of the present invention.
Figure 8B:
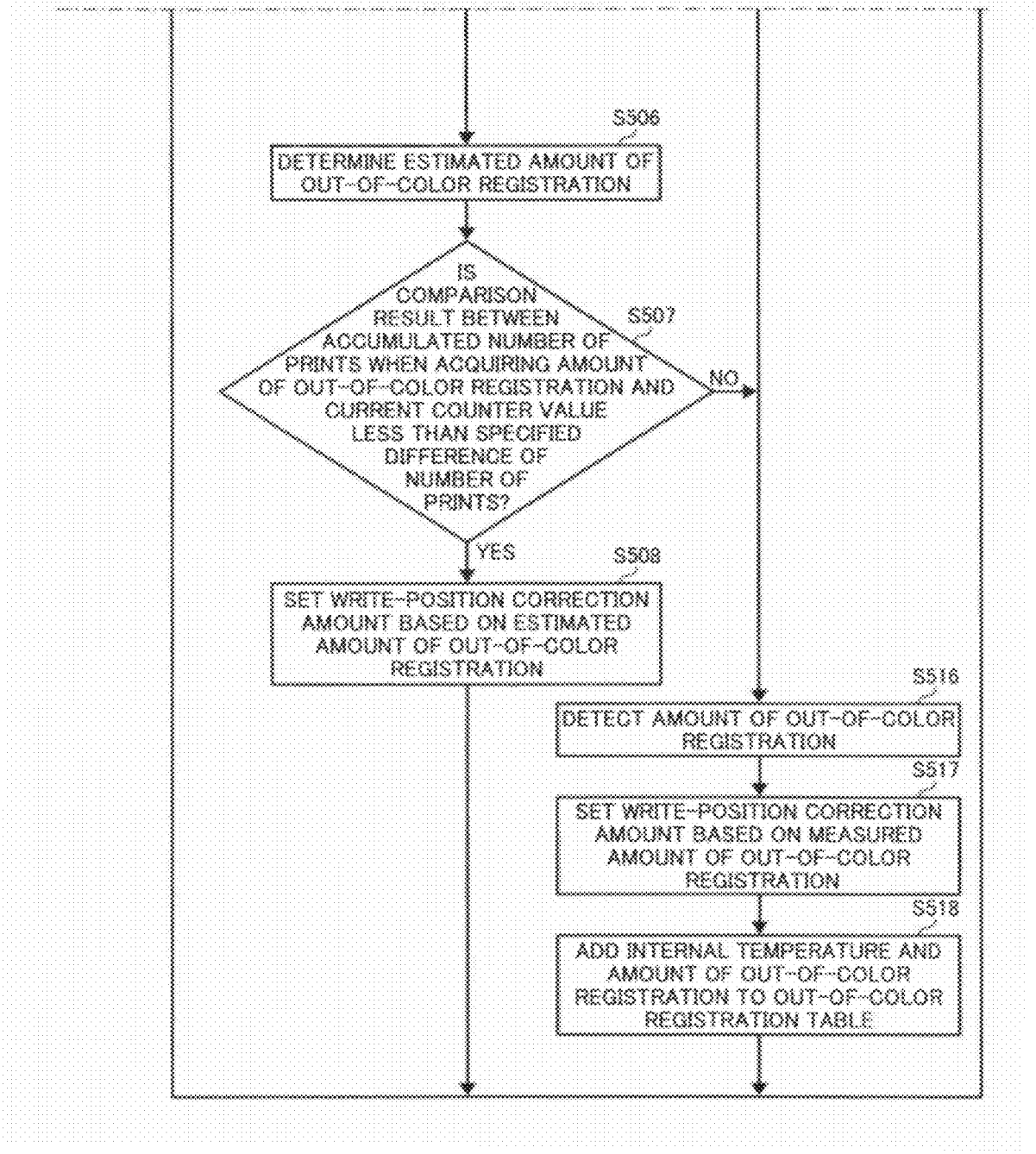

A fifth embodiment of the present invention is explained with reference to FIG. 8. FIG. 8 is a flowchart of a color image forming method according to the fifth embodiment.

In the fifth embodiment, the method of determining the estimated amount of out-of-color registration in the configuration of the fourth embodiment is partially changed. The flowchart in FIG. 8 is quite similar to that in FIG. 7, and therefore explanations of the steps that are same (Steps S509 to S513 are the same as Steps S408 to S412, Steps S504 to S508 are the same as Steps S403 to S407, Step S514 is the same as Step S413, and Step S515 is the same as Step S414) will be omitted.

When the out-of-color registration occurrence condition is satisfied (YES at Step S501), and the internal temperature is measured (Step S502), it is determined whether the user allows setting of the correction value of the write position based on the estimated amount of out-of-color registration (Step S503).

When the user allows it (YES at Step S503), control proceeds to determination whether the AIO cartridge has been replaced (Step S504). When the user does not allow it (NO at Step S503), the out-of-color registration detection pattern is formed to proceed to a process for actually measuring the amount of out-of-color registration (Steps S516 to S518).

By accumulating the amounts of out-of-color registration detected by the out-of-color registration detection pattern, an out-of-color registration characteristic specific to the machine is learnt, thereby enabling to provide the color image forming apparatus, a color image forming method, and a computer program product that can improve correction accuracy of the estimated out-of-color registration when not forming the out-of-color registration detection pattern.

When the amount of out-of-color registration is actually measured by the out-of-color registration detection pattern, it is determined whether the amount of out-of-color registration in the same machine state as that at the time of actual measurement is accumulated. When information at the time of the same machine state is accumulated, the amount of out-of-color registration is updated by the actually measured amount. When the information at the time of the same machine state is not accumulated, the machine state and the amount of out-of-color registration are added, thereby enabling to provide a color image forming apparatus, a color image forming method, and a computer program product in which the amount of out-of-color registration can be efficiently accumulated.

A color image forming apparatus, a color image forming method, and a computer program product that accumulate information in association with the machine state capable of identifying the amount of out-of-color registration by identifying the machine state based on the internal temperature can be provided.

By performing correction of the estimated out-of-color registration based on the amount of out-of-color registration agreeing with the machine state at the time of correction based on the accumulated information, a color image forming apparatus, a color image forming method, and a computer program product that can determine the estimated amount of out-of-color registration with high reliability to perform correction of the estimated out-of-color registration can be provided.

By providing a tolerance in the machine state at the time of correction of the out-of-color registration, correction of the estimated out-of-color registration is performed, even if the information of the amount of out-of-color registration at the time of machine state the same as that at the time of correction of out-of-color registration is not accumulated, thereby enabling to provide a color image forming apparatus, a color image forming method, and a computer program product in which execution frequency of the correction of the estimated out-of-color registration is improved.

When replacement of the exposure unit and the photoconductor unit is detected, the accumulated information of out-of-color registration is deleted to reconstruct the information of the amount of out-of-color registration in the state after replacement, thereby enabling to provide a color image forming apparatus, a color image forming method, and a computer program product that can correspond to a characteristic change of out-of-color registration accompanying the replacement of the exposure unit and the photoconductor unit.

The accumulated number of prints at the time of acquiring the amount of out-of-color registration is accumulated together with the internal temperature and the amount of out-of-color registration, and at the time of determining the estimated amount of out-of-color registration, it is determined whether it is effective according to a difference from the accumulated number of prints at the time of executing the correction of out-of-color registration, thereby enabling to provide a color image forming apparatus, a color image forming method, and a computer program product that can correspond to a characteristic change of out-of-color registration accompanying the change with the lapse of time.

A color image forming apparatus having high operability that can reflect user's intensions can be provided. Moreover, in the color image forming apparatus, to enable to accumulate the amount of out-of-color registration efficiently, when the amount of out-of-color registration is actually measured by the out-of-color registration detection pattern, it is determined whether the amount of out-of-color registration in the same machine state as that at the time of actual measurement is accumulated. When the information at the time of the same machine state is accumulated, the amount of out-of-color registration is updated by the actually measured amount. When the information at the time of the same machine state is not accumulated, the machine state and the amount of out-of-color registration are added, thereby enabling to provide a color image forming apparatus that can efficiently accumulate the amount of out-of-color registration.

In the printer applying the electrophotographic method, if there is distortion of the lens or the mirror due to a temperature change in the machine or a change with the lapse of time, out-of-color registration occurs. Therefore, it is known that the out-of-color registration detection pattern is formed on the transfer belt at a predetermined timing, to perform out-of-color registration correction by reading the pattern by the sensor. However, if the out-of-color registration correction operation is performed every time there is a predetermined temperature change in the internal temperature of the machine, the pattern formation and the detection operation are executed unnecessarily, thereby causing a problem in that the user cannot perform printing, the toner consumption amount for forming the pattern increases, the load on the cleaning member that collects the toner used for forming the pattern increases, or the waste toner collection capacity increases. As a technique for solving these problems, there is one disclosed in Japanese Patent Application Laid-open No. 2003-207976, in which the amount of out-of-color registration with respect to the internal temperature is held in advance, to estimate the amount of out-of-color registration based on the internal temperature, thereby correcting the out-of-color registration without forming the out-of-color registration detection pattern.

However, in this technique, because the amount of out-of-color registration to be held is a fixed value, variations in the amount of out-of-color registration due to a change with the lapse of time or individual difference of the machine cannot be dealt with, thereby causing a problem in the accuracy of out-of-color registration.

Therefore, by accumulating the amounts of out-of-color registration detected by the out-of-color registration detection pattern, the out-of-color registration characteristic specific to the machine is learnt, thereby enabling to provide the color image forming program that improves the correction accuracy of the estimated out-of-color registration when not forming the out-of-color registration detection pattern.

According to an aspect of the present invention, by accumulating the amounts of out-of-color registration detected by the out-of-color registration detection pattern, the out-of-color registration characteristic specific to the color image forming apparatus is learnt, thereby enabling to improve the correction accuracy of the estimated out-of-color registration when not forming the out-of-color registration detection pattern.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A color image forming apparatus comprising:

a color image forming unit that forms a toner image of a corresponding one of a plurality of colors on a corresponding one of a plurality of photoconductors and sequentially transfers the toner images from the photoconductors onto a transfer medium;

an out-of-color-registration amount detector that detects an amount of out-of-color registration for each color by measuring an out-of-color registration detection pattern formed on the transfer medium;

a write-position correction-amount setting unit that sets a write-position correction amount with respect to one or more of the photoconductors based on the amount of out-of-color registration detected by the out-of-color-registration amount detector;

a machine state detector that detects a machine state indicative of a state of a body of the color image forming apparatus at a time point when the out-of-color-registration amount detector detects an amount of out-of-color registration;

an out-of-color-registration table constructing unit that constructs an out-of-color registration table containing a correspondence of the amount of out-of-color registration detected by the out-of-color-registration amount detector and the machine state detected by the machine state detector;

a replacement detector configured to detect replacement of the color image forming unit; and an out-of-color-registration amount determining unit that determines, based on the out-of-color registration table, a current amount of out-of-color registration corresponding to a current machine state detected by the machine state detector, wherein the out-of-color-registration table constructing unit deletes whole or a part of the out-of-color registration table when the replacement detector detects replacement of the color image forming unit, when the out-of-color-registration amount determining unit can determine the current amount of out-of-color registration based on the out-of-color registration table, the write-position correction-amount setting unit sets the write-position correction amount based on the current amount of out-of-color registration, and when the out-of-color-registration amount determining unit cannot determine the current amount of out-of-color registration based on the out-of-color registration table, (i) the out-of-color-registration amount detector detects an amount of out-of-color registration, (ii) the write-position correction-amount setting unit sets the write-position correction amount based on the amount detected by the out-of-color-registration amount detector in (i), and (iii) the out-of-color-registration table constructing unit updates the out-of-color registration table with the amount of out-of-color registration detected by the out-of-color-registration amount detector.

2. The color image forming apparatus according to claim 1, wherein the out-of-color-registration table constructing unit determines whether the out-of-color registration table contains an amount of out-of-color registration corresponding to the current machine state detected by the machine state detector, and when the out-of-color registration table contains the amount of out-of-color registration corresponding to the current machine state, the out-of-color-registration table constructing unit does not update the out-of-color registration table, and when the out-of-color registration table does not contain the amount of out-of-color registration corresponding to the current machine state, the out-of-color-registration table constructing unit updates the out-of-color registration table with the amount of out-of-color registration detected by the out-of-color-registration amount detector.

3. The color image forming apparatus according to claim 1, wherein the machine state detector includes a temperature sensor that detects an internal temperature of the color image forming apparatus as the machine state.

4. The color image forming apparatus according to claim 2, wherein the machine state detector includes a temperature sensor that detects an internal temperature of the color image forming apparatus as the machine state.

5. The color image forming apparatus according to claim 1, wherein the out-of-color-registration amount determining unit (i) determines whether the out-of-color registration table contains an amount of out-of-color registration corresponding to the current machine state detected by the machine state detector, (ii) when the out-of-color registration table contains an amount of out-of-color registration corresponding to the current machine state, employs this amount of out-of-color registration for setting the write-position correction amount, and (iii) when the out-of-color registration table does not contain an amount of out-of-color registration corresponding to the current machine state, determines that the current amount of out-of-color registration cannot be determined based on the out-of-color registration table.

6. The color image forming apparatus according to claim 2, wherein the out-of-color-registration amount determining unit (i) determines whether the out-of-color registration table contains an amount of out-of-color registration corresponding to the current machine state detected by the machine state detector, (ii) when the out-of-color registration table contains an amount of out-of-color registration corresponding to the current machine state, employs this amount of out-of-color registration for setting the write-position correction amount, and (iii) when the out-of-color registration table does not contain an amount of out-of-color registration corresponding to the current machine state, determines that the current amount of out-of-color registration cannot be determined based on the out-of-color registration table.

7. The color image forming apparatus according to claim 1, wherein the out-of-color-registration amount determining unit (i) determines whether the out-of-color registration table contains an amount of out-of-color registration corresponding to a machine state which falls within a specified range from the current machine state detected by the machine state detector, and (ii) when the out-of-color registration table contains the amount, determines this amount as the current amount of out-of-color registration, and (iii) when the out-of-color registration table does not contain the amount, determines that the current amount of out-of-color registration cannot be determined based on the out-of-color registration table.

8. The color image forming apparatus according to claim 2, wherein the out-of-color-registration amount determining unit (i) determines whether the out-of-color registration table contains an amount of out-of-color registration corresponding to a machine state which falls within a specified range from the current machine state detected by the machine state detector, and (ii) when the out-of-color registration table contains the amount, determines this amount as the current amount of out-of-color registration, and (iii) when the out-of-color registration table does not contain the amount, determines that the current amount of out-of-color registration cannot be determined based on the out-of-color registration table.

9. The color image forming apparatus according to claim 1, further comprising a counter that counts number of sheets printed in the color image forming apparatus, the out-of-color-registration table constructing unit acquires the number of sheets counted by the counter when obtaining the amount of out-of-color registration and the machine state upon constructing the out-of-color registration table and stores the number of sheets in association with the amount and the machine state, the out-of-color registration amount determining unit, after determining the current amount of out-of-color registration, determines whether a difference between the number of sheets stored corresponding to the current amount of out-of-color registration in the out-of-color registration table and a current number of sheets counted by the counter is less than a threshold, and when the difference is less than the threshold, the out-of-color-registration amount determining unit determines to use the current amount of out-of-color registration for setting a write-position correction amount, and when the difference is equal to or larger than the threshold, the out-of-color-registration amount determining unit determines that the current amount of out-of-color registration cannot be used for setting a write-position correction amount.

10. The color image forming apparatus according to claim 1, further comprising a user selecting unit that selects whether a user allows to set the write-position correction amount based on the current amount of out-of-color registration determined based on the out-of-color registration table, wherein when the user allows setting of the write-position correction amount, the write-position correction-amount setting unit sets the write-position correction amount based on the current amount of out-of-color registration, and when the user does not allow setting thereof, the out-of-color-registration amount detector newly detects an amount of out-of-color registration, and the write-position correction-amount setting unit sets a write-position correction amount based on the amount of out-of-color registration newly detected by the out-of-color-registration amount detector.

11. A color image forming method comprising:

forming a toner image of a corresponding one of a plurality of colors on a corresponding one of a plurality of photoconductors and sequentially transferring the toner images from the photoconductors onto a transfer medium;

first detecting including detecting an amount of out-of-color registration for each color by measuring an out-of-color registration detection pattern formed on the transfer medium;

setting a write-position correction amount with respect to one or more of the photoconductors based on the amount of out-of-color registration detected at the first detecting;

second detecting including detecting a machine state indicative of a state of a body of a color image forming apparatus at a time point when an amount of out-of-color registration is detected at the first detecting;

constructing an out-of-color registration table containing a correspondence of the amount of out-of-color registration detected by the first detecting and the machine state detected by the second detecting;

third detecting including detecting replacement of a color image forming unit; and determining, based on the out-of-color registration table, a current amount of out-of-color registration corresponding to a current machine state detected in the second detecting, wherein the constructing includes deleting whole or a part of the out-of-color registration table when the replacement of the color image forming unit is detected at the third detecting, when the determining can determine the current amount of out-of-color registration based on the out-of-color registration table, the setting sets the write-position correction amount based on the current amount of out-of-color registration, and when determining cannot determine the current amount of out-of-color registration based on the out-of-color registration table, (i) the first detecting detects an amount of out-of-color registration, (ii) the setting sets the write-position correction amount based on the amount detected by the first detecting in (i), and (iii) the constructing updates the out-of-color registration table with the amount of out-of-color registration detected by the first detecting.

12. A computer program product comprising a non-transitory computer usable medium having computer readable program codes embodied in the medium that, when executed, causes a computer to execute:

forming a toner image of a corresponding one of a plurality of colors on a corresponding one of a plurality of photoconductors and sequentially transferring the toner images from the photoconductors onto a transfer medium;

first detecting including detecting an amount of out-of-color registration for each color by measuring an out-of-color registration detection pattern formed on the transfer medium;

setting a write-position correction amount with respect to one or more of the photoconductors based on the amount of out-of-color registration detected at the first detecting;

second detecting including detecting a machine state indicative of a state of a body of a color image forming apparatus at a time point when an amount of out-of-color registration is detected at the first detecting;

constructing an out-of-color registration table containing a correspondence of the amount of out-of-color registration detected by the first detecting and the machine state detected by the second detecting;

third detecting including detecting replacement of a color image forming unit; and determining, based on the out-of-color registration table, a current amount of out-of-color registration corresponding to a current machine state detected in the second detecting, wherein the constructing includes deleting whole or a part of the out-of-color registration table when the replacement of the color image forming unit is detected at the third detecting, when the determining can determine the current amount of out-of-color registration based on the out-of-color registration table, the setting sets the write-position correction amount based on the current amount of out-of-color registration, and when determining cannot determine the current amount of out-of-color registration based on the out-of-color registration table, (i) the first detecting detects an amount of out-of-color registration, (ii) the setting sets the write-position correction amount based on the amount detected by the first detecting in (i), and (iii) the constructing updates the out-of-color registration table with the amount of out-of-color registration detected by the first detecting.

* * * * *